United States Patent [19]

Desjardins

[11] Patent Number: 4,729,561

[45] Date of Patent: Mar. 8, 1988

[54] WEIGHTLIFTING POWER STATION

[76] Inventor: Charles J. Desjardins, 20 New Park Ave., Hartford, Conn. 06103

[21] Appl. No.: 925,294

[22] Filed: Oct. 31, 1986

[51] Int. Cl.[4] ..... A63B 21/06

[52] U.S. Cl. ..... 272/117; 272/134

[58] Field of Search ..... 52/646; 272/134, 117, 272/144, 118; 211/186, 70.4, 70.5

[56] References Cited

U.S. PATENT DOCUMENTS

| | | | |
|---|---|---|---|
| 3,501,140 | 3/1970 | Eichorn | 272/144 X |
| 3,527,354 | 9/1970 | Sokolow | 211/70.5 |
| 3,948,513 | 4/1976 | Pfotenhauer | 272/134 X |
| 4,142,637 | 3/1979 | Kraiss | 211/182 |
| 4,252,314 | 2/1981 | Ceppo | 272/134 X |
| 4,257,590 | 3/1981 | Sullivan et al. | 272/144 X |
| 4,407,495 | 10/1983 | Wilson | 272/134 X |
| 4,492,375 | 1/1985 | Connelly | 272/144 X |
| 4,637,608 | 1/1987 | Owens et al. | 272/144 |
| 4,650,186 | 3/1987 | McCreery et al. | 272/134 |
| 4,653,751 | 3/1987 | Green | 272/144 |

*Primary Examiner*—Carl D. Friedman

*Attorney, Agent, or Firm*—Chilton, Alix & Van Kirk

[57] ABSTRACT

A power station for use in weightlifting has a multistation configuration comprising two substantially rectilinear cages which are connected in abutting back-to-back relationship. Racks for mounting weights are formed on the cages. A horizontal bench press is removably mounted to one of the cages and an inclined bench press having an adjustable foot rest and an adjustable seat is removably mounted to the other cage.

11 Claims, 4 Drawing Figures

WEIGHTLIFTING POWER STATION

BACKGROUND OF THE INVENTION

This invention relates generally to power stations which are adaptable for use in weightlifting. More particularly, the present invention relates generally to weightlifting power stations having a compact form and adaptable for a wide variety of weightlifting exercises.

SUMMARY OF THE INVENTION

Briefly stated, the invention in a preferred form is a station which is adaptable for use in weightlifting. The station has a compact form, is relatively easily assembled and disassembled, and is adaptable for a wide variety of weightlifting activities. The station comprises a first cage having a substantially rectilinear form with a base and four substantially parallel vertically extending members defining a first open compartment. A second cage has a substantially rectilinear form with a base and four substantially parallel vertically extending members which define a second open compartment. A pair of vertical members of the first cage are disposed in abutting connecting relationship with a corresponding pair of upright members of the second cage.

A plurality of vertically spaced racks extend from the abutting vertical members and project generally away from the abutting members. Weight bar cradles are mounted to the non-abutting upright members and are adjustably positionable at a fixed location of the members for suspending a weight bar between corresponding pairs of upright members. A horizontal bench is removably mounted to one of the cage bases and projects outwardly relative to the one cage. An inclined bench is disposed at an oblique angle with respect to the upright members and projects outwardly relative to the other cage. The inclined bench is removably mounted to the other cage. A cross-bar extends between upright members of the other cage to support the inclined bench. Brackets are mounted to each of the non-abutting upright members. The brackets are adjustably positionable at a fixed location of the associated upright members to form a horizontally projecting rail.

A platform is removably mounted to the base of the other cage and disposed within the other cage compartment. Projections extend from non-abutting upright members at an upper location of the members for mounting weight bar collars. The cradle preferably comprises a generally J-shaped member which is mounted to a member having spaced side portions which receivably closely engage opposing sides of an upright member for sliding movement therealong. The brackets are in the form of a reinforced L-shaped member with one leg of the bracket having a series of slots. An upright member has a socket for capturing the slotted leg to permit limited sliding movement along the upright member. The socket includes a slot which is alignable with slots of the bracket for fixing the location of the bracket.

The inclined bench comprises an elongated lateral support member which connects with a cage base and an inclined support rail which extends at an acute angle to the lateral member. A seat extends generally perpendicular to the support rail and is variably positionable at a fixed position on the inclined support rail. A generally T-shaped member extends perpendicularly to the inclined rail and is variably positionable at a fixed position spaced from the rail to form a foot rest.

An object of the invention is to provide a new and improved weightlifting power station having a compact form which is adaptable for a wide variety of weightlifting activities.

Another object of the invention is to provide a new and improved power weightlifting station which has a sturdy construction and may be readily assembled and disassembled to facilitate portability of the station.

A further object of the invention is to provide a new and improved multi-station assembly for weightlifting wherein the weights and weightlifting equipment may be efficiently stored on the station to immobilize the station and add stability to the station and the weightlifting equipment is readily available for use in various weightlifting activities performed at the station.

A further object of the invention is to provide a new and improved weightlifting power station having multi-station capabilities wherein the station may be efficiently stored in a relatively small storage space.

Other objects and advantages of the invention will become apparent from the specification and the drawings.

DETAILED DESCRIPTION OF THE INVENTION

Figure 1:
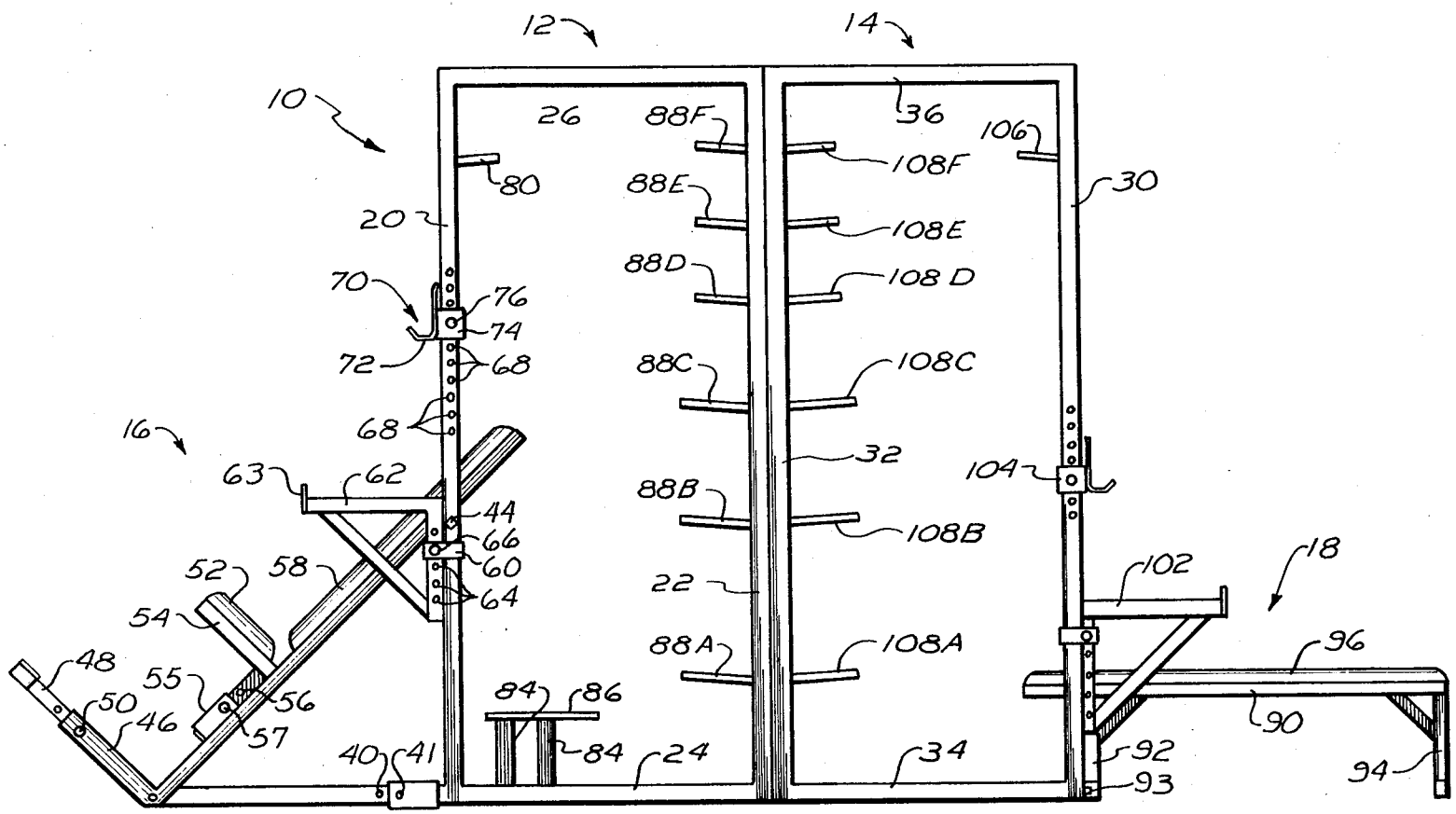
FIG. 1 is a side elevational view of a weightlifting power station in accordance with the present invention.

With reference to the drawings wherein like numerals represent like parts throughout the figures, a weightlifting power station in accordance with the present invention is generally designated by the numeral 10. Power station 10 is a multi-station assembly having a relatively compact form which is adaptable for use with a wide variety of interchangeable accessories to provide a compact power station suitable for a wide variety of weightlifting activities. Because of the preferred application of the power station, the power station has a rugged, sturdy construction which is preferably primarily formed of tubular steel or other rugged materials.

Power station 10 comprises a pair of upstanding generally rectilinear cages 12 and 14 which form open compartments and provide structural support for various accessories of the power station as will be further detailed below. In the illustrated embodiment, an inclined bench press assmbly 16 is removably mounted to cage 12, and a horizontal bench press assembly 18 is removably mounted to cage 14.

Cage 12 comprises a pair of elongated forward supports 20 and a pair of elongated rear supports 22 which project vertically from a rectangular base frame 24 in parallel fashion. Pairs of horizontally disposed lateral cross-bars 26 and transverse cross-bars 28 connect at the top of supports 20 and 22 to provide a rigid frame construction.

Likewise, cage 14 comprises a pair of elongated forward supports 30 and a pair of elongated rear supports 32 which project vertically from a rectangular base frame 34 in parallel fashion. Pairs of horizontally disposed lateral cross-bars 36 and transverse cross-bars 38 connect at the top of supports 30 and 32 to provide a rigid frame construction. Rear supports 22 and 32 are preferably bolted together in back to back fashion to rigidly interlock the frames to provide a quasi uniframe-type construction. In an alternate form (not illustrated), a single central upright support may be employed in place of a connected rear support 22 and rear support 32.

The bases, supports, and cross-bars of the cages are preferably formed of 2 inch tubular steel. Each cage in a preferred embodiment has a base dimension of approximately 3 feet by 4 feet and a height of approximately 8 feet. Each of the foregoing cages 12 and 14 may be constructed by welding and/or bolting together the foregoing described members.

The inclined bench press assembly 16 comprises a telescoping support beam 40 which is bolted to a central portion of the lower rectangular base frame 24 and projects forwardly from the cage 12. A bench rail 42 is pivotally joined at the terminus of support beam 40 at an acute angle to form the inclined support structure for the inclined bench press. A transverse cross-bar 44 extends between supports 20 at an intermediate vertical position to provide an upper support for rail 42.

A tubular extension 46 extends at a right angle to bench rail 42 and projects at an angle to the support beam 40 to mount an adjustable foot rest. A T-shaped member 48 is slidably received in the outer end of member 46 and longitudinally adjustable therein. The oppositely projecting transverse extensions of member 48 mount diamond ridged plates 49 which function as the foot rests. The leg of member 48 has a series of slots which are alignable with a slot in the tubular extension. A pin 50 may be inserted in suitably aligned slots of the T-shaped member 48 and the extension 46 to provide a fixed variable adjustment to the foot rest.

A padded seat 52 is mounted to a generally L-shaped bracket 54 which is adjustably positionable along the bench rail 42. A closed end socket 55 is mounted at the top of the bench rail 42. The socket slidably receives one leg of bracket 54. The closed end of the socket functions as a stop to define the lowest position of the seat 52. The bracket leg has a series of slots 56 which are alignable with a corresponding slot of socket 55 to provide a variable adjustment to the position of the seat 52. A pin 57 is insertable in alignable slots of the bracket 54 and the socket 55 to selectively fix the position of the seat.

A padded back pad 58 is mounted to the upper section of the bench rail 42 to form the back support for the inclined bench press.

The bench rail 42 ia pivotally mounted to the support beam 40. The support beam 40 has a telescoping configuration which allows the distance between the pivotal connection and the support frame to be selectively fixed at a plurality of preestablished distances to provide an inclined bench press having an adjustable angle of inclination. A spring loaded pin 41 extends through aligned slots of the telescoping sections of the support beam to fix the length of the beam.

A pair of generally U-shaped straps 60 are welded to supports 20 at a position slightly below the cross-bar 44. The straps 60 extend forwardly from the supports to form vertically extending receiving receptacles. Each strap 60 slidably receives a leg of a reinforced L-shaped or triangular shaped safety bracket 62 which slides along a forward face of the support 20. Bracket 62 includes a vertical series of slots 64 which are alignable with aligned slots in each of the straps 60 so that the bracket may be adjustably vertically positioned and secured in fixed position by means of a removable pin 66 inserted through aligned slots of the strap 60 and the bracket 62. The upper leg of each of the safety brackets projects forwardly at a right angle to the support 20 and terminates in a vertically protruding stop 63. The function of the safety brackets 62 is to provide a safety bridge for catching the weight bar in the event of a mishap, or in the event that the weight bar is accidentally dropped, etc., to thereby prevent injury to the weightlifter and/or damage to the power station and the surrounding structures and equipment.

The upright supports 20 also include a vertical series of aligned slots 68 which are adapted to removably adjustably mount bar cradles 70. Each of the bar cradles 70 includes a quasi J-shaped member 72 which is adapted to project forwardly from the corresponding supports 20 for cradling the weightlifting bar (not illustrated). A generally U-shaped metal mounting plate 74 is welded to the back of the J member 72. The mounting plate engages the front and opposing side surfaces of support 20. The mounting plate 74 includes opposed slots (not illustrated) which are alignable with a corresponding slot 68 for adjusting the vertical position of the bar cradle 70. A pin 78 is employed to securably fix the vertical position of the bar cradle upon insertion through aligned slots 76 and 68.

A pair of pegs 80 (only one illustrated) extend at a slight acute angle to a normal line to the forward supports 20. The pegs 80 project inwardly and slightly upwardly from upper portions of each of the supports 20 to provide racks which are suitable for mounting the collars (not illustrated) for the weight bar.

Figure 2:
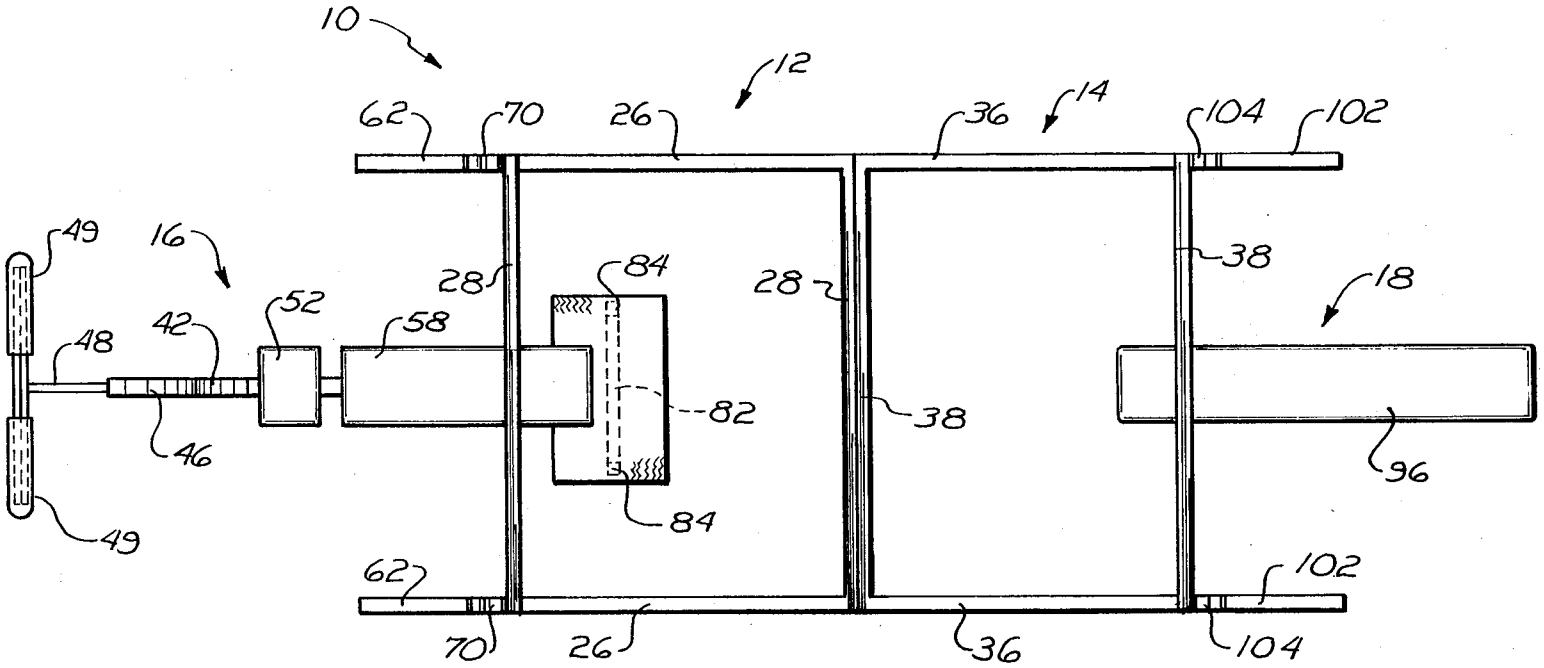
FIG. 2 is a top plan view of the power station of FIG. 1.
Figure 4:
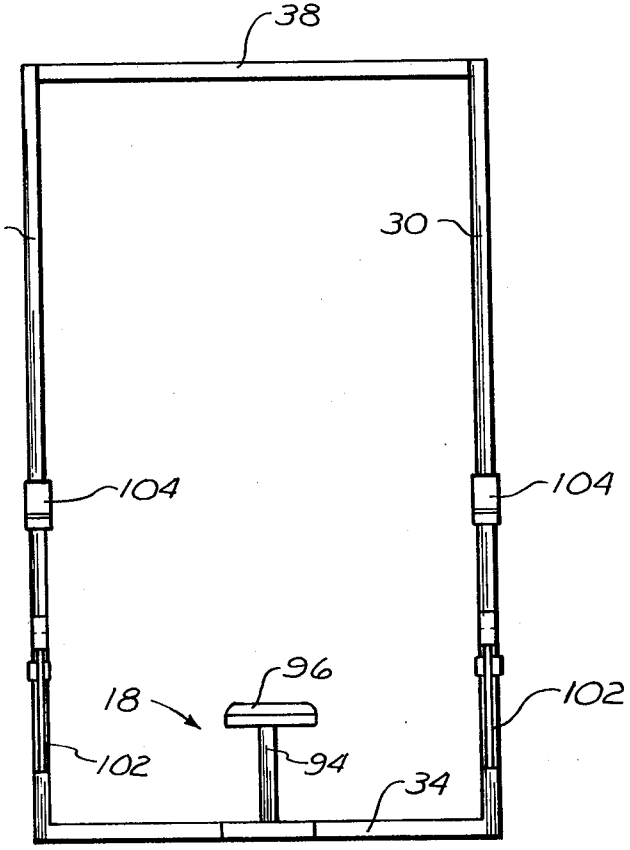
FIG. 4 is an end view of the power station of FIG. 1 looking toward the left thereof.
Figure 3:
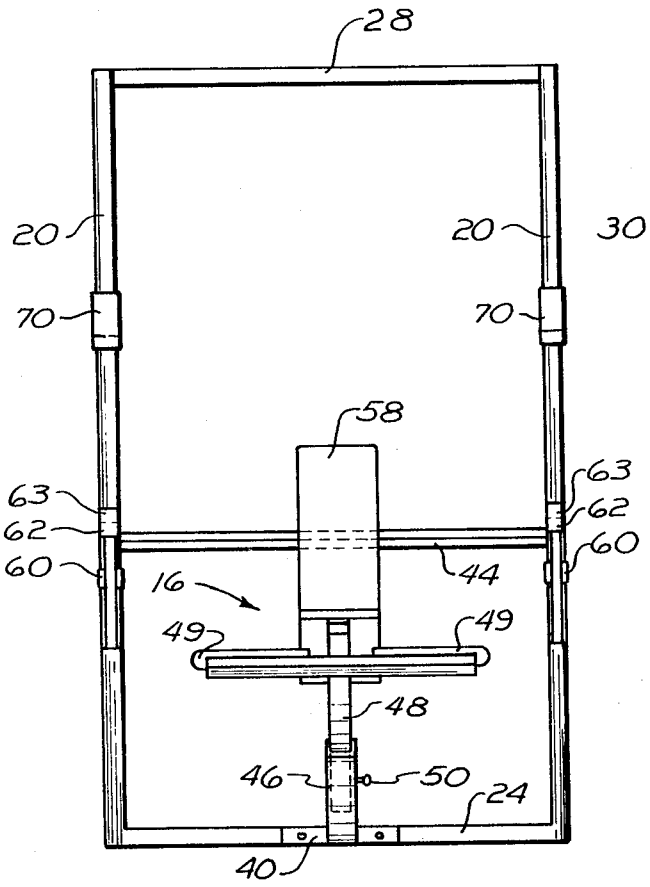
FIG. 3 is an end view of the power station of FIG. 1 looking toward the right thereof.

The terminus of the leg of a T-shaped base 82 (illustrated in phantom in FIG. 2) is bolted at a central portion of the base frame 24 and extends inwardly into the cage 12. Three legs 84 extend vertically from the base 82 to provide a support for a spotter platform 86. Platform 86 has a rectangular shape and a diamond ridged upper surface. The platform 86 is preferably formed of a rugged steel material which is sufficient to support the weight and activities of a spotter for a weightlifter using the inclined press bench assembly 16.

A series of pegs **88*a* through 88*f* extend inwardly and slightly upwardly from the rear supports 22 at a slight angle on the order of 5° relative to a normal line to the rear supports. The pegs 88 are adapted to provide support racks for slidably receiving and storing the weights (not illustrated). The weights mounted to the racks are in sufficiently close proximity to the inclined bench press to allow the weights to be easily removed from the racks and mounted to a weight bar suspended between the bar cradles 70 without requiring that the weightlifter bend over to lift the weights prior to mounting the weights on the weight bar. Naturally, the weights may also be dismounted from the weight bar and returned to the racks 88** without the weightlifter bending over to return the weights to a storage position.

The horizontal bench press assembly 18 comprises a horizontally extending bench rail 90 which extends between a pair of I-shaped support legs 92 and 94. Leg 92 has a lower flange 93 which is bolted to the central outer portion of the base frame 34. The leg rests on the top of the base frame and extends vertically to support the bench rail 90. Leg 94 is spaced from the cage and provides the outer support for the bench. A bench pad 96 is mounted to the top of bench rail 90 and extends the length thereof. The foregoing horizontal bench press 18 may be dismounted from the cage 14 by unbolting the lower portion of the leg 92 from the base frame 34.

Except for the bench press assembly 18, cage 14 is essentially a mirror image of cage 12. Cage 14 includes safety brackets 102, bar cradles 104, pegs 106, and rack pegs 108 *a–f* which are identical in form and function to the respective safety brackets 62, bar cradles 70, pegs 80 and rack pegs 88 *a–f* previously described with respect to cage 12.

It should be appreciated that the structural integrity of the power station is enhanced by storing the weights on the various racks 88 and 108 of the cages. The stored weights function to immobilize the power station and lend stability to the power station. In addition, both the inclined bench press assembly 16 and the horizontal bench press assembly 18 may be easily dismounted from the respective cages and either replaced with other accessories (not illustrated) and/or stored within the cages. Consequently, the power station 10 is adapted to assume a compact form when not in use. In a preferred embodiment of the power station 10, the supports, the base frames, the cross-bars and other components are bolted together and may be easily disassembled so that the power station components may be placed in a generally flat container for storage and/or transportation purposes. Consequently, although the illustrated power station 10 has a sturdy rugged construction suitable for the strenouos demands associated with weightlifting, the power station is efficiently constructed and very portable.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and scope of the present invention.

What is claimed is:

1. A station adaptable for use in weightlifting comprising:

first cage means for forming an upright cage of substantially rectilinear form comprising a base and four substantially parallel vertically extending supports defining a first open compartment;

second cage means for forming an upright cage of substantially rectilinear form comprising a base and four substantially parallel vertically extending supports defining a second open compartment, said first cage and said second cage being disposed in adjacent connected relationship at a central location with opposing pairs of said vertical extending supports being disposed at said central location and first and second pairs of vertical supports being transversely spaced from said central supports;

a plurality of vertically spaced pegs extending from said central vertical supports in fixed relationship therewith so as to form vertically spaced pairs of oppositely projecting pegs which are oriented to project upwardly at an angle on the order of 5 degrees relative to a normal line to the central vertical supports, said pegs being dimensioned and spaced so that weights may be mounted thereto;

cradle means mounted to said first vertical supports and adjustably positionable at a fixed location of said first vertical supports for suspending a weight bar between a corresponding pair of said first vertical supports;

first bench means removably mounted to one said cage base for forming a generally horizontally disposed bench projecting transversely outwardly relative to said one cage;

second bench means removably mounted to said other cage for forming an inclined bench disposed at an oblique angle with respect to said vertical supports and projecting transversely outwardly relative to said other cage, a crossbar extending between vertical supports of said other cage to support said inclined bench; and bracket means mounted to said second vertical supports and adjustably positionable at a fixed location of said second vertical supports for forming a pair of generally parallel horizontally projecting rails.

2. The station of claim 1 further comprising a platform removably mounted to the base of said other cage and disposed within said other cage compartment.

3. The station of claim 1 further comprising at least one peg mounted to a selected vertical support at an upper location and extending generally toward a said central support.

4. The station of claim 1 wherein said cradle means comprises a generally J-shaped member mounted to a generally U-shaped mounting member having spaced portions which closely engage opposing sides of a vertical support.

5. The station of claim 4 wherein said engaged vertical support has a series of vertically spaced slots, said U-shaped mounting member has a pair of aligned slots, and a pin inserted through said mounting member slots and a slot of said support secures the mounting member at a fixed vertical position.

6. The station of claim 1 wherein the bracket means comprises an L-shaped bracket, one leg of said bracket having a series of slots, and further comprising having socket means mounted to a support for capturing the slotted leg to permit limited sliding movement along said support, said socket means including a slot alignable with slots of said bracket.

7. The station of claim 1 wherein said second bench means comprises an elongated lateral support member connecting said other base and an inclined support rail mounted to said lateral support member and extending at an acute angle to said lateral support member.

8. The station of claim 7 further comprising a seat extending generally perpendicularly to said inclined support rail, said seat being variably positionable at a fixed position on said inclined support rail.

9. The station of claim 7 further comprising a generally T-shaped member extending at an angle to said inclined support rail, said T-shaped member being variably positionable at a fixed position spaced from said support rail.

10. The station of claim 7 wherein the length of the lateral support member may be adjustably fixed at a plurality of lengths to provide a plurality of acute angles between the lateral support member and the inclined support rail.

11. the station of claim 1 further comprising a peg mounted to each of said first and second pairs of vertical supports at an upper location thereof and extending generally toward said central vertical supports, each said peg being oriented to project upwardly at an angle on the order of 5 degrees relative to a normal line to the respective vertical supports.

* * * * *